US010118069B2

(12) United States Patent
Grossman et al.

(10) Patent No.: US 10,118,069 B2
(45) **Date of Patent: *Nov. 6, 2018**

(54) EXERCISE DEVICE

(71) Applicants: Jay Grossman, Los Angeles, CA (US); Zak Lee Guarnaccia, Los Angeles, CA (US)

(72) Inventors: Jay Grossman, Los Angeles, CA (US); Zak Lee Guarnaccia, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/851,575

(22) Filed: Dec. 21, 2017

(65) Prior Publication Data

US 2018/0117395 A1 May 3, 2018

Related U.S. Application Data

(63) Continuation of application No. 15/057,442, filed on Mar. 1, 2016, now Pat. No. 9,878,203.

(60) Provisional application No. 62/133,206, filed on Mar. 13, 2015.

(51) Int. Cl.

| | |
|---|---|
| ***A63B 26/00*** | (2006.01) |
| ***A63B 23/02*** | (2006.01) |
| ***A63B 21/00*** | (2006.01) |
| ***A63B 21/068*** | (2006.01) |
| ***A63B 23/04*** | (2006.01) |
| *A63B 69/00* | (2006.01) |

(52) U.S. Cl.

CPC .... *A63B 23/0211* (2013.01); *A63B 21/00047* (2013.01); *A63B 21/068* (2013.01); *A63B 21/4029* (2015.10); *A63B 23/0405* (2013.01); *A63B 2069/0062* (2013.01)

(58) Field of Classification Search

CPC ..... A63B 21/00047; A63B 21/4011; A63B 21/4013; A63B 21/4027; A63B 21/4029; A63B 23/02; A63B 23/0205; A63B 23/0211; A63B 2225/093; A63B 23/0216; A63B 23/0222; A63B 23/0227

See application file for complete search history.

(56) References Cited

U.S. PATENT DOCUMENTS 3,682,475 A * 8/1972 Walker ..... A63B 23/0211 482/140

4,508,335 A * 4/1985 Kelley ..... A63B 23/0211 482/140

(Continued)

*Primary Examiner* — Joshua Lee

(74) *Attorney, Agent, or Firm* — J D Harriman

(57) ABSTRACT

An exercise bench for use by a person on a support surface includes a base member having a distal end, a proximal end, a top surface, and a bottom surf ace. A pair of opposing foot restraints is fixed with, and disposed above and laterally away from, the base member. A riser projects upwardly from the proximal end of the base member and includes a calf restrain trolley slidably mounted thereon. Two opposing calf restraints each project laterally away from the riser. The calf restraint trolley has a height adjustment mechanism cooperative with the riser. A base plate can be fixed with the bottom surface of the base member, and a U-shaped base extension having two legs extending away from the proximal end of the base member can be attached to the proximal end of the base member to inhibit tipping of the exercise bench during use.

6 Claims, 3 Drawing Sheets

(56) References Cited

U.S. PATENT DOCUMENTS 5,935,050 A * 8/1999 Shahan ..... A63B 23/0211 482/140
6,048,293 A * 4/2000 Lee ..... A63B 23/0211 482/140
6,287,244 B1 * 9/2001 Boos ..... A63B 21/068 482/142
6,315,702 B1 * 11/2001 Ikonomopoulos ..... A63B 23/0355 482/100
6,692,418 B2 * 2/2004 Shahan ..... A63B 23/02 482/143
7,004,894 B1 * 2/2006 Trotter ..... A63B 23/02 482/140
7,662,077 B1 * 2/2010 Liu ..... A63B 23/02 482/142
8,096,930 B1 * 1/2012 Leon ..... A63B 21/00181 482/130
8,465,403 B2 * 6/2013 McCall, Jr. ..... A63B 23/0205 482/142
8,801,640 B2 * 8/2014 Sevy ..... A63B 21/0442 482/131
9,119,984 B2 * 9/2015 Littell ..... A63B 26/00
9,370,688 B1 * 6/2016 Pannozzo ..... A63B 23/0405
2002/0147084 A1 * 10/2002 Liang ..... A63B 21/023 482/140
2005/0101460 A1 * 5/2005 Lobban ..... A63B 23/0211 482/140
2006/0217249 A1 * 9/2006 Webber ..... A63B 23/02 482/142
2011/0143890 A1 * 6/2011 Reyes ..... A63B 21/154 482/99
2011/0319237 A1 * 12/2011 Jones ..... A63B 21/00047 482/140
2012/0115693 A1 * 5/2012 Franques Garcia ..... A63B 23/0211 482/140

* cited by examiner

EXERCISE DEVICE

This patent application is a continuation of, and claims priority to, U.S. patent application Ser. No. 15/057,442 filed on Mar. 1, 2016 and claims priority to U.S. Provisional Patent Application 62/133,206 filed on Mar. 13, 2015, both of which are incorporated by reference herein in their entirety.

BACKGROUND OF THE SYSTEM

Sit-up exercises are well known for exercising a person's abs, legs and core muscle groups. Yet sit-up exercises typically require the exerciser's feet to be held down in some manner on the floor, such as with the assistance of another person. But such assistance is not always available or convenient for the other person.

Therefore, there is a need for a device that facilitates a full repertoire of sit-up exercises to be performed without the aid of another person. Such a needed device would provide for a variety of sit-up exercises, and would maintain a stable position on a floor surface. Such a needed device would be relatively inexpensive to manufacture, easy to use, store and transport. The present invention accomplishes these objectives.

SUMMARY

The present device is an exercise bench for use by a person on a support surface. A base member has a distal end, a proximal end, a top surface, and a bottom surface. A pair of opposing foot restraints is fixed with and disposed above and laterally away from the base member. Each foot restraint includes a padded cylindrical annulus for comfortable contact with the person's feet.

A riser is fixed at a lower end thereof with and projects upwardly from the proximal end of the base member. A calf restraint trolley is slidably mounted on the riser and has a pair of opposing calf restraints that each project laterally away from the riser. The calf restraint trolley has a height adjustment mechanism cooperative with the riser and adapted to allow selective height adjustment of the calf restraint trolley on the riser.

As such, with the base member mounted to the support surface and with the person positioned with each of his feet under one of the foot restraints and the calf restraint trolley height adjusted such that each calf restraint is positioned behind a calf of the person, the person may perform sit-up exercise on the support surface. The exercise bench may further include a base plate fixed with the bottom surface of the base member and extending laterally outwardly therefrom, such that the person stands on the base plate to anchor the exercise bench to the support surface with his weight, thereby not requiring that the base member be mounted to the support surface.

In another embodiment, the exercise bench further includes a rigid U-shaped base extension having two legs extending away from the proximal end of the base member. As such, the person may perform the sit-up exercises while lying on the support surface between the two legs of the base extension. The base extension prevents the exercise bench from tipping over when the weight of the person is centered beyond the proximal end of the base member.

The present invention facilitates a full repertoire of sit-up exercises without the aid of another person. The present device provides for a variety of sit-up exercises, and maintains a stable position on a floor surface during use. The present invention is relatively inexpensive to manufacture, easy to use, store and transport. Other features and advantages of the present invention will become apparent from the following more detailed description, taken in conjunction with the accompanying drawings, which illustrate, by way of example, the principles of the invention.

DETAILED DESCRIPTION OF THE SYSTEM

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
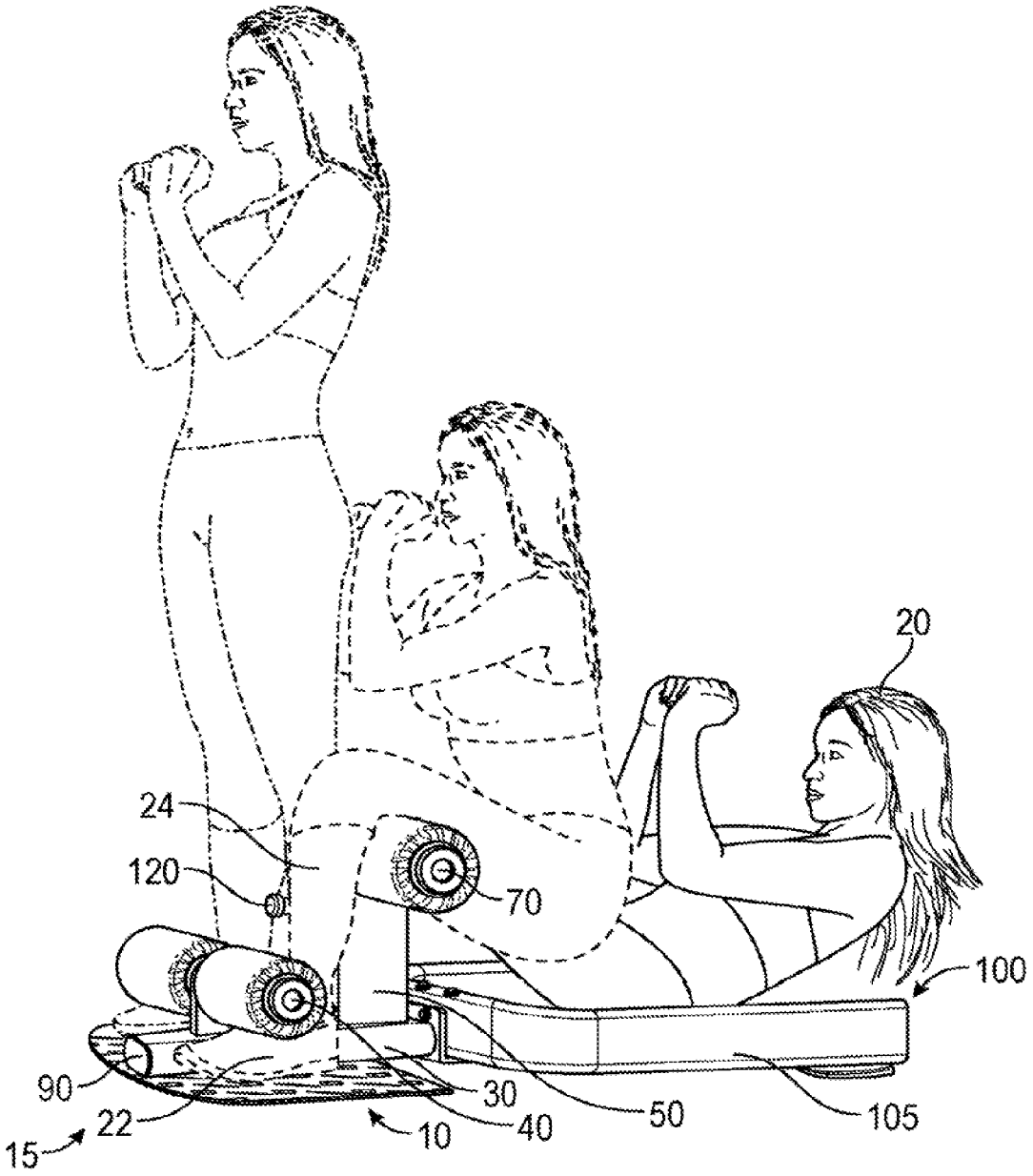
FIG. 1 is a perspective view of the exercise bench of the invention, illustrating several different exercise positions of a person using the exercise bench.
Figure 2:
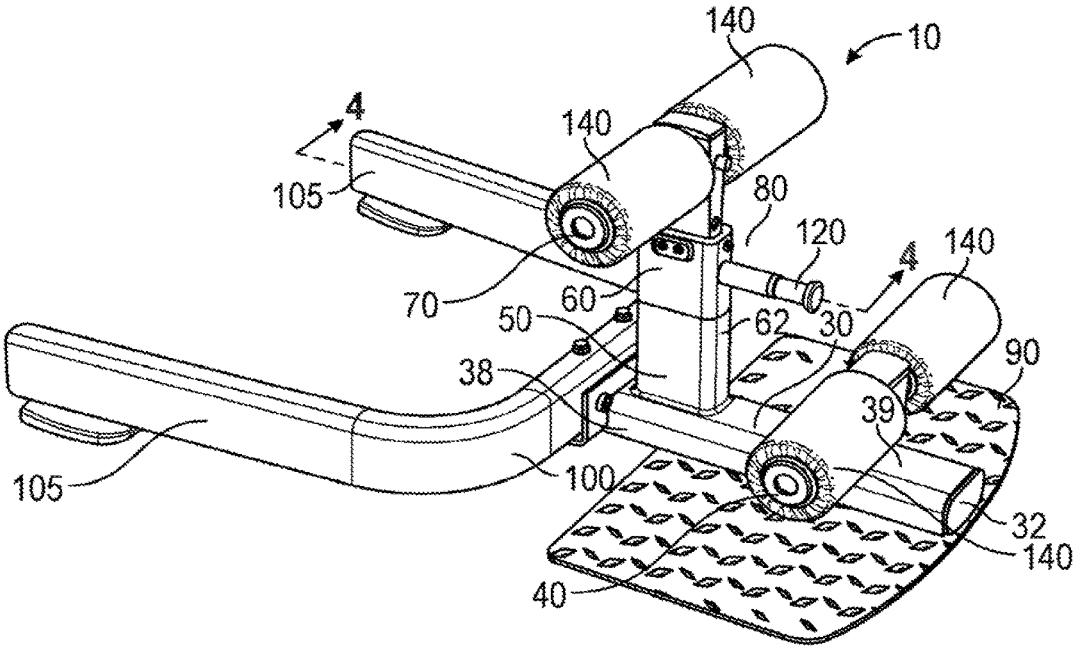
FIG. 2 is an alternate perspective view of the invention.
Figure 3:
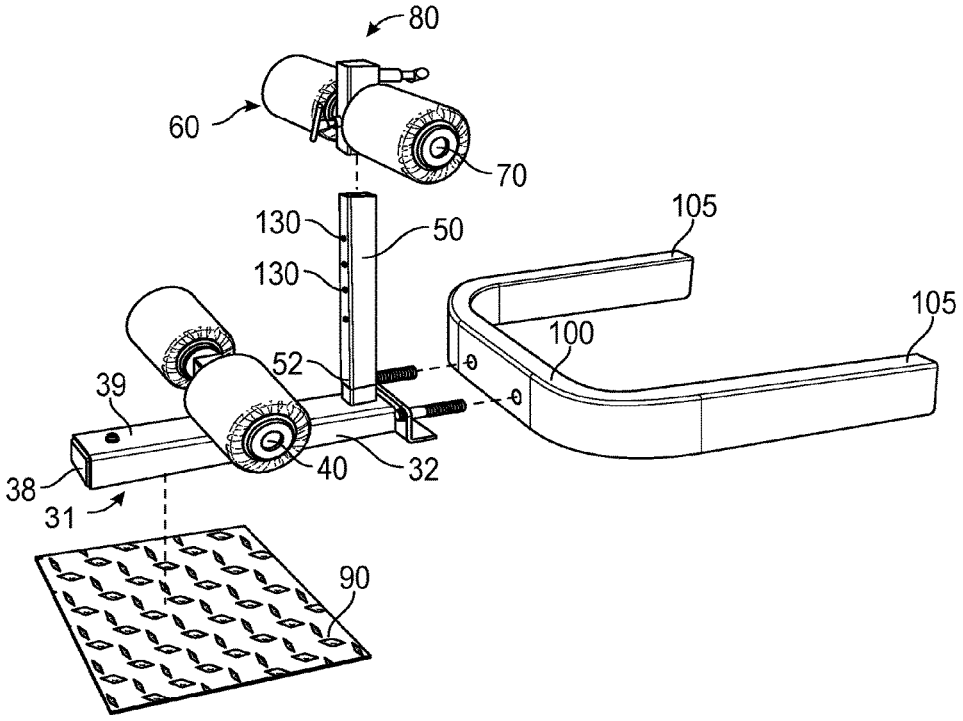
FIG. 3 is an exploded perspective view of the invention.

FIGS. 1 and 2 illustrate an exercise bench 10 for use by a person 20 on a support surface 15, such as a floor surface. A rigid base member 30 has a distal end 38, a proximal end 32, a top surface 39, and a bottom surface 31 (shown in FIG. 3). A pair of opposing foot restraints 40 is fixed with and disposed above the base member 30. Each foot restraint 40 projects laterally away from the base member 30. Preferably each foot restraint 40 includes a padded cylindrical annulus 140 for comfortable contact with the person's feet 22. Preferably the rigid base member 30 is made from a strong and durable metallic material.

A riser 50 is fixed at a lower end 52 thereof with and projects upwardly from the proximal end 32 of the base member 30. A calf restraint trolley 60 is slidably mounted on the riser 50 and has a pair of opposing calf restraints 70 that each project laterally away from the riser 50. The calf restraint trolley 60 has a height adjustment mechanism 80 cooperative with the riser 50 and adapted to allow selective height adjustment of the calf restraint trolley 60 on the riser 50. Preferably each calf restraint 70 includes one of the padded cylindrical annuli 140 for comfortable contact with the person's calves 24. Preferably the riser 50 is made from a strong and durable metallic material. The lower end 52 of the riser 50 may be welded to the proximal end 32 of the base member 30, or otherwise mechanically and rigidly fastened thereto.

Figure 4:
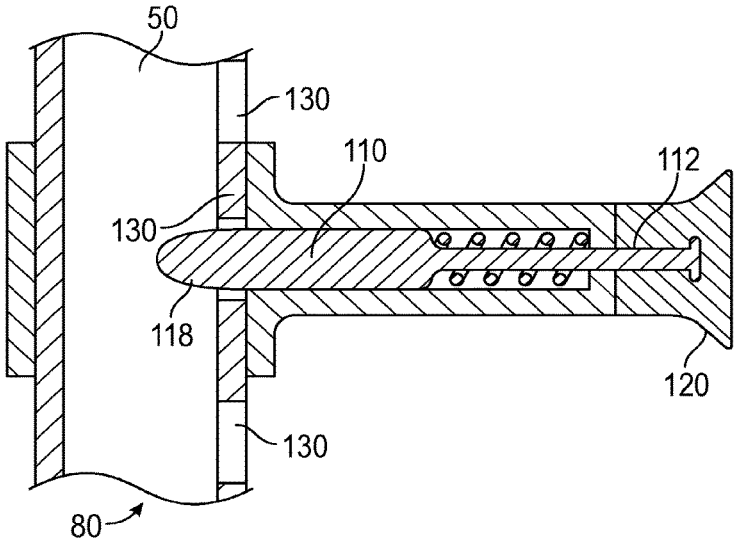
FIG. 4 is a partial cross-sectional view of a height-adjustable calf restraint trolley of the invention.

Preferably the height adjustment mechanism 80 includes a spring-biased pin 110 (FIG. 4) that has a knob 120 at a proximal end 112 thereof. A distal end 118 of the pin 110 is urged into one of a plurality of height apertures 130 formed in the riser 50. As such, the calf restraint trolley 60 may be selectively positioned at a height of any one of the height apertures 130 by engaging the distal end 118 of the pin 110 into a selected one of the height apertures 130. The height adjustment mechanism 80 is preferably fixed on a proximal side 62 of the calf restraint trolley 60, centered between each calf restraint 70.

As such, with the base member 30 mounted to the support surface 15, such as with bolts (not shown), and with the person 20 positioned with each of his feet 22 under one of the foot restraints 40 and the calf restraint trolley height 60 adjusted such that each calf restraint 70 is positioned behind a calf 24 of the person 20, the person 20 may perform sit-up exercise on the support surface 15 (FIG. 1).

In a preferred embodiment, the exercise bench 10 further includes a base plate 90 (FIGS. 2 and 3) fixed with the bottom surface 31 of the base member 30. The base plate 90 extends laterally outwardly from the base member 30, such that the person 20 stands on the base plate 90 to anchor the exercise bench 10 to the support surface 15 with his weight, thereby not requiring that the base member 30 be mounted to the support surface 15. Preferably the base plate is a relatively thin sheet metal material that either includes or does not include a high-friction surface pattern or material (not shown).

In another embodiment, the exercise bench 10 further includes a rigid U-shaped base extension 100 (FIGS. 1-3) having two legs 105 extending away from the proximal end 32 of the base member 30. As such, the person 20 may perform the sit-up exercises while lying on the support surface 15 between the two legs 105 of the base extension 100. The base extension 100 prevents the exercise bench 10 from tipping over when the weight of the person 20 is centered beyond the proximal end 32 of the base member 30. The base extension 100 is preferably made from a strong and durable metallic material and selectively bolted with the base member 30. As such, for portability and storage, the base extension 100 may be selectively removed from the base member 30.

While a particular form of the invention has been illustrated and described, it will be apparent that various modifications can be made without departing from the spirit and scope of the invention. For example, The U-shaped base extension 100 may take a different shape, such as a V-shape or Y-shape (not shown). Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise bench for use by a person on a support surface, comprising:

a base member disposed on the floor and having a distal end, terminating in a proximal end, a top surface, and a bottom surface;

a pair of opposing foot restraints fixed with and disposed above the base member, each foot restraint projecting laterally away from the base member;

a riser fixed with and projecting upwardly from the proximal end of the base member at a lower end thereof;

a calf restraint trolley slidably mounted on the riser and having a pair of opposing calf restraints each projecting laterally away from the riser, the calf restraint trolley having a height adjustment mechanism cooperative with the riser and adapted to allow selective height adjustment of the calf restraint trolley on the riser;

a removably coupled U-shaped base extension having two legs extending away from the proximal end of the base member;

whereby the exercise bench is configured to allow, the person to position his back on the support surface with each of his feet under one of the foot restraints and with the calf restraint trolley height adjusted such that each calf restraint is positioned behind a calf of the person, the person may perform sit-up exercises.

2. The exercise bench of claim 1 whereby the person may perform sit-up exercises while lying between the two legs of the U-shaped base extension.

3. The exercise bench of claim 1 wherein the height adjustment mechanism includes a spring-biased pin having a knob at a proximal end thereof, the distal end urged into one of a plurality of height apertures formed in the riser, whereby the calf restraint trolley may be selectively positioned at a height of one of the height apertures by engaging the distal end of the spring-biased pin into a selected one of the height apertures.

4. The exercise bench of claim 3 wherein the height adjustment mechanism is fixed on a proximal side of the calf restraint trolley centered between each calf restraint.

5. The exercise bench of claim 1 wherein each foot restraint includes a padded cylindrical annulus.

6. The exercise bench of claim 1 wherein each calf restraint includes a padded cylindrical annulus.

* * * * *